US006381895B1

(12) United States Patent
Keeney et al.

(10) Patent No.: US 6,381,895 B1
(45) Date of Patent: May 7, 2002

(54) OVER BARREL GAS TUBE OPTICAL SIGHT MOUNT

(76) Inventors: Lyle J. Keeney, P.O. Box 70, Palouse, WA (US) 99161; Randall S. Keeney, 1524 NW. Leland, Pullman, WA (US) 99163

( * ) Notice: Subject to any disclaimer, the term of this patent is extended or adjusted under 35 U.S.C. 154(b) by 0 days.

(21) Appl. No.: 09/715,457

(22) Filed: Nov. 16, 2000

(51) Int. Cl.[7] ..... F41G 1/38
(52) U.S. Cl. ..... 42/124; 42/124; 42/111
(58) Field of Search ..... 42/124, 111, 134

(56) References Cited

U.S. PATENT DOCUMENTS 3,671,000 A * 6/1972 Williams
4,026,054 A * 5/1977 Snyder ..... 42/101
4,026,055 A * 5/1977 Weast ..... 42/101
4,044,486 A * 8/1977 Van Holten ..... 52/101
4,299,044 A * 11/1981 Johannsen ..... 42/101
4,571,870 A * 2/1986 Heideman et al. ..... 42/101
4,756,111 A * 7/1988 Lapier ..... 42/101
4,835,895 A * 6/1989 Bowen ..... 42/101
5,428,915 A * 7/1995 King ..... 42/101
5,590,484 A * 1/1997 Mooney et al. ..... 42/103
5,595,011 A 1/1997 Gorslin
5,787,630 A * 8/1998 Martel ..... 42/101
5,806,228 A * 9/1998 Martel et al. ..... 42/101
5,826,363 A 10/1998 Olson

OTHER PUBLICATIONS

Aimtech New Products published 1998.

* cited by examiner

*Primary Examiner*—Peter M. Poon
*Assistant Examiner*—Lulit Semunegus
(74) *Attorney, Agent, or Firm*—Wells St. John P.S.

(57) ABSTRACT

An optic mount is described for an AK47-type rifle having a barrel, a rear gas tube receiver block and a forward barrel mounted gas chamber block. The optic mount includes a rigid body with an optic mount surface. The mount provides a gas tube passageway between the rear gas tube receiver block and forward barrel mounted gas chamber block of the rifle. A barrel mounting member is configured to secure the rigid body to the barrel.

20 Claims, 5 Drawing Sheets

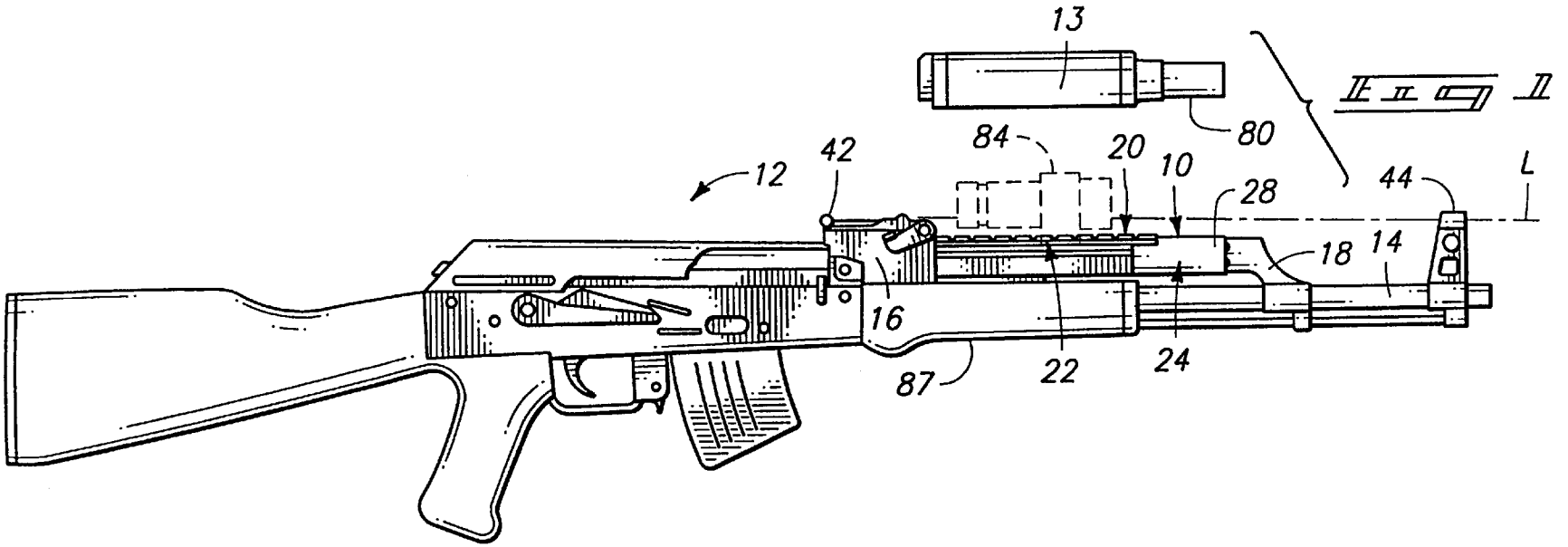
II
L
44
14
18
28
80
10
24
20
13
22
84
87
16
42
12
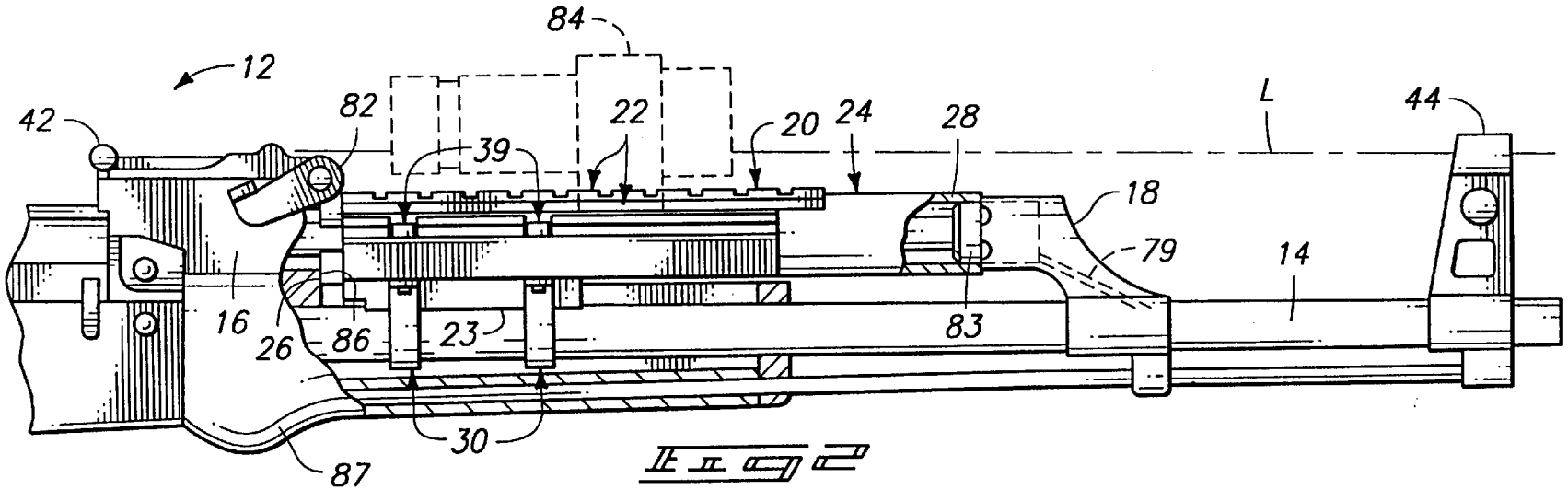
44
L
14
18
79
28
83
24
20
22
84
39
23
30
82
86
87
26
16
12
42

OVER BARREL GAS TUBE OPTICAL SIGHT MOUNT

TECHNICAL FIELD

The present invention relates generally to mounting optics on an over barrel gas tube rifle and more particularly to mounting an optic at a low position and at a forward location along the barrel of an AK47-type rifle.

BACKGROUND OF THE INVENTION

Quick target acquisition and sighting is a constant goal for hunting, military action, police engagements, self defense or sport shooting. Iron sights take time for the shooter to properly align with the target. Telescopic sights do not significantly improve speed because the visual difference between the real and magnified image requires adjustment by the shooter. Low power optics improve the shooter's quick sighting by increasing the shooter's field of view. They are also less demanding in regard to the precision with which the shooter's eye must be aligned with the optic. To be most effective, the low power optics should be spaced a considerable distance from the shooter's eye. However, conventional telescopic sight mounts must generally be secured to the rifle receiver so the telescopic sight is positioned close to the shooter's eye.

Shooters of Kalashnikov or AK47-type rifles are also faced with unique problems if they desire sighting capability other than the standard iron sights provided on such weapons. The construction of the AK47-type rifle is intended for reliability and simplicity. The configuration of an AK47-type rifle will thus typically include easy to disassemble components and usually includes an over-barrel gas tube for operating the action of the rifle. The breech and barrel are not easily accessible for mounting optic type sights, and existing mounts that do not secure the sights to the barrel must find support, either on the side of the receiver or on a removable part of the weapon. Those who mount optics to removable parts of a weapon sacrifice a large degree of consistency and accuracy since the removable parts are not absolutely stationary with respect to the rifle barrel.

Both of the above problems are addressed to a degree by Gorslin in U.S. Pat. No. 5,595,011. Gorslin makes use of the forward sight ramp and the forward gas tube block of an AK47-type rifle for securing a telescopic sight mount. The advantage of such a mount is that the sight may be permanently mounted to the rifle. Thus the sight may remain in place on the rifle even through field stripping operations required for proper cleaning. However, while the mounting problem appears to be solved, there is no direct connection between the rifle barrel and the optic mount. Forward sight ramps and forward gas blocks on AK47-type rifles are seldom attached in perfect alignment along the rifle barrel, but instead may be rotated slightly about the barrel, in permanent misalignment with one another. Any misplacement of this nature may seriously affect the available windage and elevation adjustment of the optic on the mount.

Further in Gorslin, the optics are mounted so far forward on the barrel that proper balance of the weapon is affected and both ends of the telescopic sight are positioned almost directly adjacent discharge gas blast areas. The forward end of the sight is situated almost in alignment with the muzzle, and the rearward sight end is adjacent the gas tube release ports. The optics are thus in danger of harm or fouling from high temperature discharge gasses and from physical damage due to blows to the exposed optics as the weapon is carried Another aspect of Gorslin which is considered in the patent as an advantage is that the optics are spaced above the sight line for the iron sights. This extra height further increases exposure of the mounted optic to possible damage. The mount includes openings formed about the sight line area so the shooter can see front and back sights if sighting is desired through the standard iron sights. However, the shooter must elevate his or her eye from the iron sight to a much higher elevation if the telescopic sight is to be used. This either requires an awkward unsupported movement for the shooter, or provision of an elevated cheek piece on the rifle stock (which interferes with or eliminates use of the iron sights as an option).

Other forms of optic mounts for AK47-type rifles have been used, but such mounts, as indicated above, typically mount to parts of the rifle that require removal for frequent periodic cleaning or maintenance. Old Soviet designs require holes to be drilled in the receiver and are plagued by requirements for extra height to allow removal of the receiver dust cover for cleaning or service.

A need has therefor remained for an optic mount for AK47-type rifles that is carried low on the weapon while allowing for alternative use of the optic sight or the standard iron sights.

A need has also remained for an optic mount for AK47-type rifles that may be secured directly to the rifle barrel in a permanent location so the sight need not be removed or adjusted to allow for field stripping of the rifle for cleaning or periodic maintenance.

A further need has remained for a practical, stable optic mount for AK47-type rifles that requires no drilling or significant alteration to any part of the rifle.

A still further need has remained for an optic mount that will position the optic in a position safe from discharge gasses or from physical damage when the weapon is fired or carried.

The above needs are addressed and are believed to be fulfilled by is provision of the present invention, examples of which are disclosed herein.

BRIEF DESCRIPTION OF THE DRAWINGS

Preferred embodiments of the invention are described below with reference to the following accompanying drawings.

FIG. 1 is a side elevation view of an AK47-type rifle with a preferred form of the present optic mount thereon;

FIG. 2 is an enlarged fragmented view thereof;

DESCRIPTION OF PREFERRED EMBODIMENTS

Figure 3:
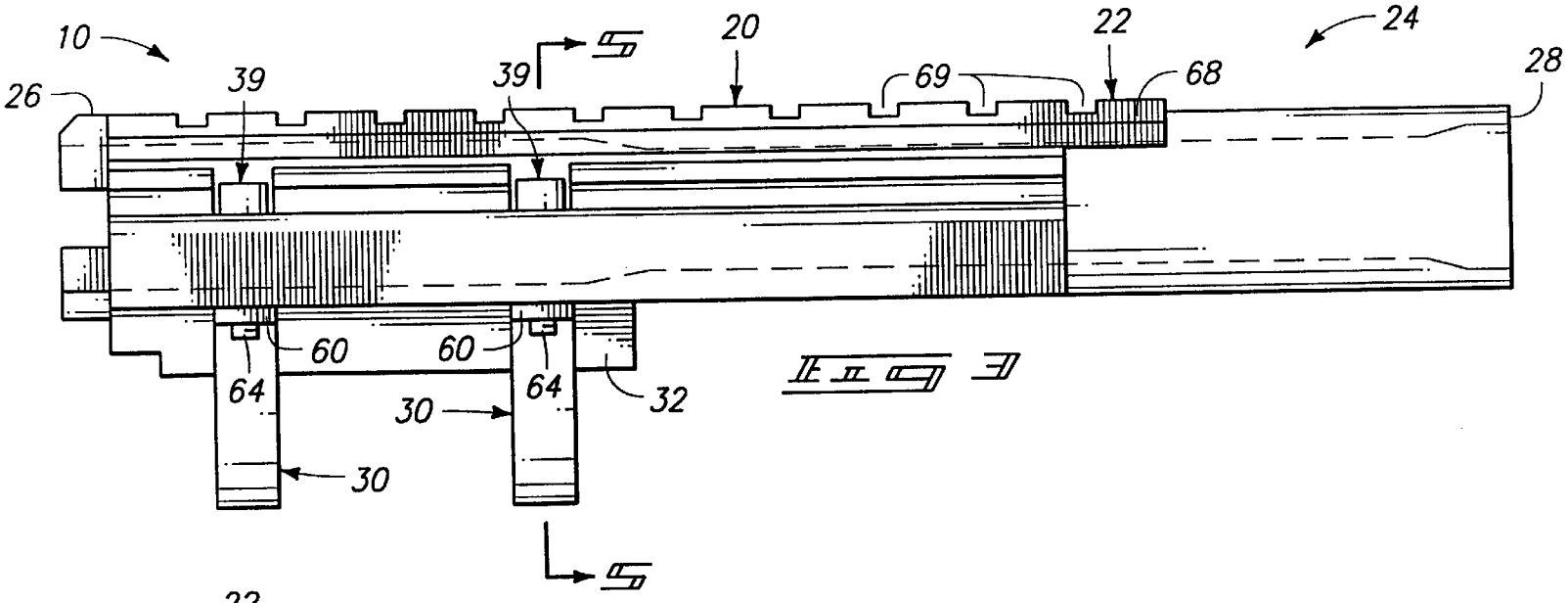
FIG. 3 is an enlarged side elevation view of the preferred optic mount.

This disclosure of the invention is submitted in furtherance of the constitutional purposes of the U.S. Patent Laws "to promote the progress of science and useful arts" (Article 1, Section 8).

General Aspects

Before describing details of preferred embodiments, general aspects of the invention will first be described, with reference numerals referring to exemplary parts of the accompanying illustrations.

In a first aspect, an optic mount 10 is provided for an AK47-type rifle 12 which includes a barrel 14, a rear gas tube receiver block 16 and a forward barrel Mounted gas chamber block 18. The optic mount 10 includes a rigid body 20 with an optic mount surface 22 thereon. A gas tube 24 is provided on the rigid body 20. The gas tube includes opposed open ends 26, 28 that are configured to be mounted to the rifle 12 between the rear gas tube receiver block 16 and the forward barrel mounted gas chamber block 18. A barrel mounting member 30 is releasably attached to the rigid body 20 and is configured to secure the rigid body 20 to the barrel 14.

In another aspect in an AK47-type rifle 12 having a barrel, a rear gas tube receiver block 16 and a forward barrel mounted gas chamber block; the optic mount 10 includes a rigid body 20 including an optic mount surface 22 thereon and a gas tube 24. The gas tube 24 is mounted to the rifle 12 between the rear gas tube receiver block 16 and the forward barrel mounted gas chamber block 18. A barrel mounting member 30 connects the rigid body 20 and the barrel 14.

In a further aspect, the optic mount 10 is provided for an AK47-type rifle barrel 14. The mount 10 includes a rigid body 20 including an optic mount surface 22 and a barrel mounting surface 23 thereon. A gas tube spacer 32 on the rigid body 20, spaces the optic mount surface 22 from the barrel mounting surface 23 and defines a gas tube passageway 34 with the rigid body 20 between the barrel mounting surface 23 and the optic mount surface 22. A barrel mounting member 30 on the rigid body 20 depends from the barrel mounting surface 23 to form a barrel receiving throat 36. In a still further aspect, in an AK47-type rifle 12 having a barrel 14, a rear iron sight 42 and a front iron sight 44 defining a line of sight L with the rear iron sight 42, a rear gas tube receiver block 16 and a forward barrel mounted gas chamber block 18; the optic mount 10 includes a rigid body 20 including an optic mount surface 22 thereon. The rigid body 20 is mountable to the rifle 12 between the rear gas tube receiver block 16 and the forward barrel mounted gas chamber block 18 with the optic mount surface 22 situated between the barrel 14 and the line of sight "L". A barrel mounting member 30 on the rigid body 20 is engageable with the barrel 14 to secure the rigid body 20 to the barrel 14.

Detailed Description

Before discussing preferred, exemplary components of the present optical mount 10, a brief discussion will be made regarding the AK47-type rifle 12. One example of such a weapon is illustrated in FIG. 1. Numerous other configurations of the AK47 style are commercially available and available to military throughout the world. The basic AK47-type rifle is also known as the Kalashnikov style rifle, after its Russian inventor. The typical AK47-type is well known and will not be described in substantial detail herein. However, for descriptive purposes to provide a better understanding of preferred forms of the invention, some features of a typical AK47-type rifle will be briefly described.

As indicated above, the rifle barrel 14 includes the forward mounted gas chamber block 18. A gas duct 79 (dashed lines in FIG. 2) is formed in the block 18 for delivering pressurized gasses from the barrel 14 against a piston mounted within an elongated gas tube 80 (shown separated from the rifle 12 in FIG. 1) upon discharge of the weapon. A piston (not shown) is provided for sliding movement in the gas tube 80 in response to reception of pressurized gasses. The piston moves in reaction to the presence of discharge gas pressure, to operate an attached bolt mechanism to eject a spent cartridge, cock the hammer, and chamber a fresh cartridge. The piston, hammer and bolt mechanisms are not shown, but are well known to manufacturers and users of AK47-type rifles.

The gas tube 80 is typically removable from between the forward mounted gas chamber block 18 and the rear gas tube receiver block 16 for cleaning and maintenance purposes. To this end, a release lever 82 is generally provided on the rear gas tube receiver block 16. Operation of the lever 82 will allow the gas tube to be lifted from engagement with a tenon 83 on the forward gas chamber block 18, and from a gas tube receiving socket 86 (FIG. 2) on the rearward gas tube receiver block 16.

Figure 8:
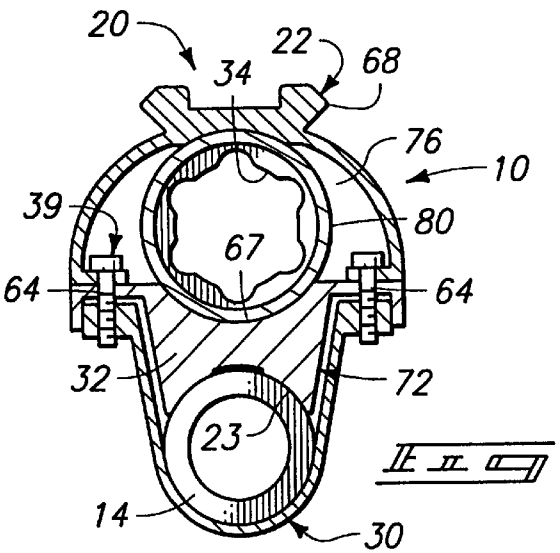
FIG. 8 is a sectional view through another form of the present optic mount.

It is noted that in preferred forms of the present invention, the conventional gas tube 80 may be eliminated in forms where the gas tube 24 is integrated with the mount 10 (FIGS. 1–7 and 9), or be used in conjunction with the mount as exemplified by FIG. 8. Both forms allow for mounting the optics 84 at a low position such that either the optics 84 or the conventional iron sights 42, 44 may be used for sighting.

With low mounted, low power optics, the shooter will be able to use either sighting arrangement without changing cheek position. This will allow for fast target acquisition without forcing the shooter to physically shift to whichever sight arrangement is to be used. Further, the low mounted optics will minimize the overall height dimension of the rifle (that is, the vertical dimension when the rifle is held horizontally in a shooting position).

It is pointed out that the nature of the optics may vary, and that the optics themselves are conventional and available commercially. It may be preferred to use low power optics for the purposes stated above, since the low mount capability will allow for mounting of the optics well within the line of sight L through the standard iron sights 42, 44. Low power optics will allow free use of the iron sights through the optical lenses or allow sighting using the optics. Either sighting option may be used without changing the cheek or eye elevation.

In preferred forms of the mount 10, the rigid body 20 may be formed of a conventional metal material, such as aluminum or steel, by such conventional techniques as extrusion, casting, machining, stamping, or forging. Any singular technique or combination thereof may be used to form the mount. In the preferred example illustrated by FIGS. 1–5, the rigid body 20 may be initially extruded, then machined to the desired configuration.

In the example illustrated by FIGS. 1–5, the rigid body 20 includes an integrated optic mount surface 22, barrel mount surface 23, and gas tube 24. It is preferred that these three elements be accurately positioned in relation to one another so the optics 84 may be mounted on the rifle with the sighting axis of the optics in substantial parallel alignment with the axis of the rifle bore. It is also preferred that the three elements be spatially related such that when the rigid body 20 is mounted to the rifle, the optic mount surface 22 will be situated below the line of sight L for the standard iron sights 42, 44. This is done to enable low mounting of the optics, the advantages of which are noted above.

The optic mount surface 22 includes a longitudinal mounting rail 68 (see FIG. 4) that is disposed along the rigid body 20. It is preferable that the rail 68 be oriented in relation to the barrel mount surface 23 in substantial parallelism with the bore axis of the barrel 14 when the mount 10 is secured to the rifle. The shape and spacing of the rail 68 with appropriate notching may be provided to accept conventional forms of optic mounting.

Figure 6:
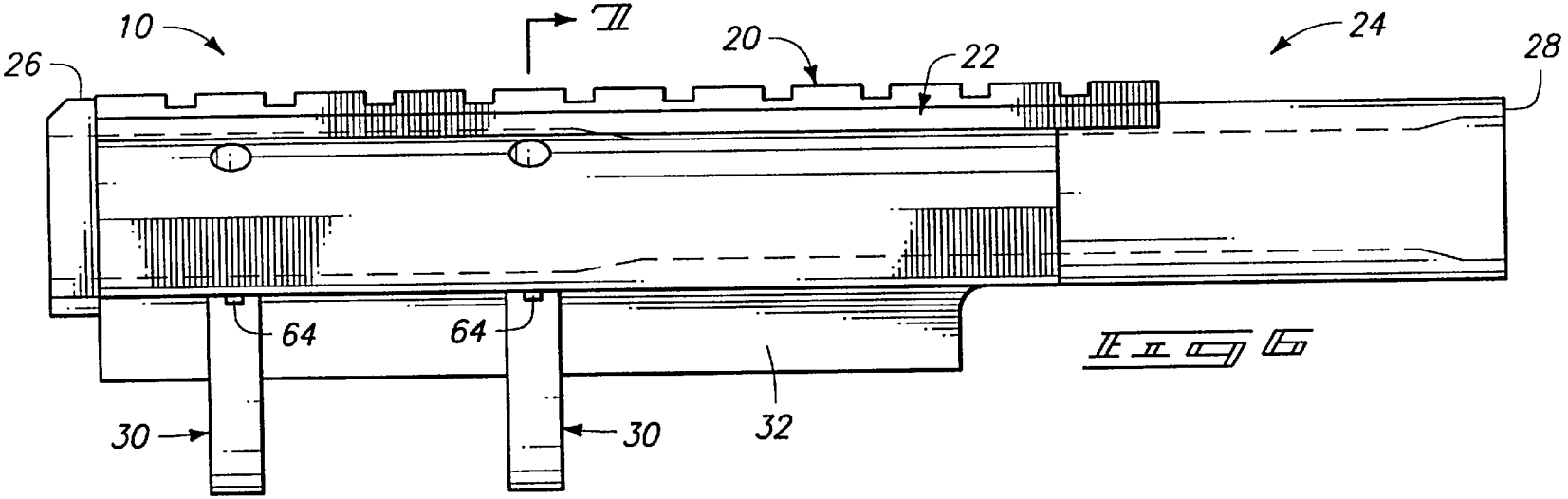
FIG. 6 is a side elevational view exemplifying another form of the present optic mount.
Figure 7:
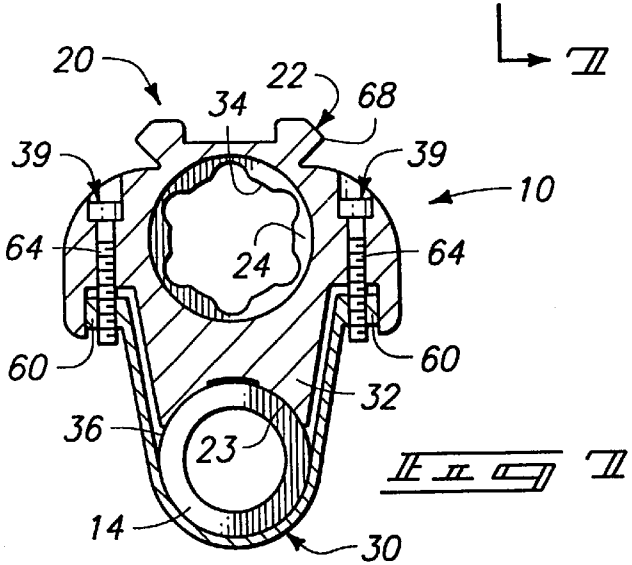
FIG. 7 is a sectional view taken substantially along line 7—7 in FIG. 6 but also showing the exemplified optic mount secured to a rifle barrel.

In the form shown by FIGS. 1–5 and 9, longitudinal notches 70 may be provided for heat dissipation purposes and overall weight reduction of the mount 10. The form shown by FIGS. 6, 7 and 8 shows the mount with the rigid body 20 taking a shape beneath the rail 68, resembling that of the standard hand guard 13 (FIG. 1) that is releasably mounted to the gas tube 80 on many forms of AK47-type rifles.

The barrel mounting surface 23 is exemplified in two forms in the drawings. In the forms exemplified by FIGS. 2–7 and 9, the barrel mounting surface 23 is integral with the rigid body 20. In the example illustrated by FIG. 8, the barrel mounting surface 23 is provided along one or more spacer blocks 72 that may be separable from the remainder of the mount to allow for continued use of the existing rifle gas tube 80 as will be explained in further detail below. If desired, either form may include provisions for a heat insulator pad or spacer (FIG. 5) that may be used to minimize direct heat transfer from the barrel 14 to the rigid body 20.

In the above configurations, the barrel mounting surface 23 may be provided to operably engage the rifle barrel 14 along top portions thereof to seat and position the mount 10 with respect to the barrel, and provide a surface against which the barrel mounting member 30 may act to firmly secure the mount 10 to the rifle barrel. To this end, it is preferable that at least part of the barrel mounting surface 23 be of a generally concave shape, complimentary to a portion of the rifle barrel as shown by the examples illustrated in FIGS. 4, 5, 7, and 8. The illustrated surface 23 preferably orients the mount 10 in an at least substantially parallel relation to the barrel.

In preferred forms of the mount 10, and as generally described above, the gas tube spacer 32 is provided on the rigid body to space the optic mount surface 22 from the barrel mounting surface 23 and to define the gas tube passageway 34 between the barrel mounting surface and the optic mount surface. In the preferred forms illustrated by FIGS. 1–7 and 9, the spacer 32 is integral with the rigid body 20. In the exemplary form illustrated by FIG. 8, the spacer 32 is provided as part of the separate spacer block 72. In either exemplary form, the gas tube spacer 32 achieves the function of either defining or locating the gas tube passageway 34 such that the gas tube, whether it be integrated with (FIG. 3) or separate from (FIG. 8) the mount 10, will be properly positioned between the gas tube receiver block 16 and the gas chamber block 18 on the rifle 12.

As noted above, the gas tube passageway 34 may be provided in alternate forms. In a first preferred form exemplified in FIG. 4, the passageway 34 structurally defines or becomes the bore of the gas tube 24. The gas tube 24 in this form is also an integral part of the rigid body 20. Thus, in this form, the gas tube passageway 34 is formed by the rigid body 20. In another form (FIG. 8), the passageway 34 may be defined by the spacer 32 and body 20 as a space 76 for receiving an existing gas tube 80. In the example shown by FIG. 8, the existing gas tube 80 from the original weapon is captured within the body 20, and is accepted in the conventional manner between the blocks 16 and 18.

In a preferred form, the gas tube 24 extends forwardly from the end 26 which is shaped to be received by existing surfaces (socket 86) on the rear gas tube receiver block 16 of the rifle. The forward end 28 may be received over the tenon 83 on the forward gas chamber block, much in the same manner as the existing gas tube 80 is mounted to the rifle. It is noted 8 however that the conventional release lever 82 need not be used for connecting the gas tube end 26 since the entire optic mount including the gas tube is secured in position by the barrel mounting members 30.

As noted, the front open end 28 of the gas tube 24, as shown by FIG. 2 may be fitted over the gas tube tenon 83 on the gas chamber block 18 in the same manner as a conventional gas tube. Thus, in the preferred forms shown by FIGS. 1–7 and 9, the gas tube 24 may be used to replace the existing gas tube 80, with the passageway 34 positioned to slidably receive the piston (not shown). Operation of the rifle will therefor be similar if not identical to operation of the rifle with its existing gas tube.

Figure 9:
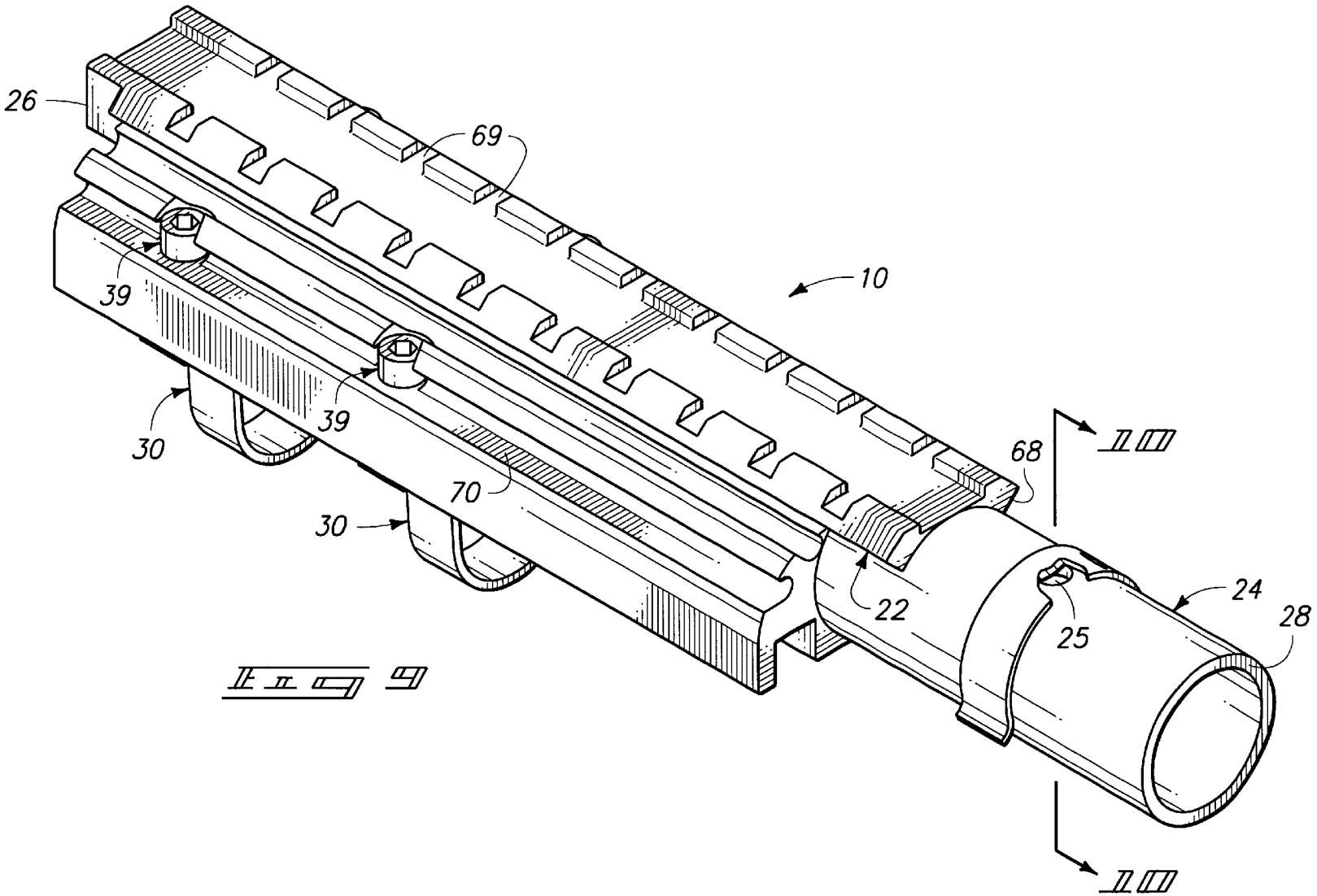
FIG. 9 is a perspective view of a preferred optic mount similar to the mount shown in FIGS. 1–5.
Figure 10:
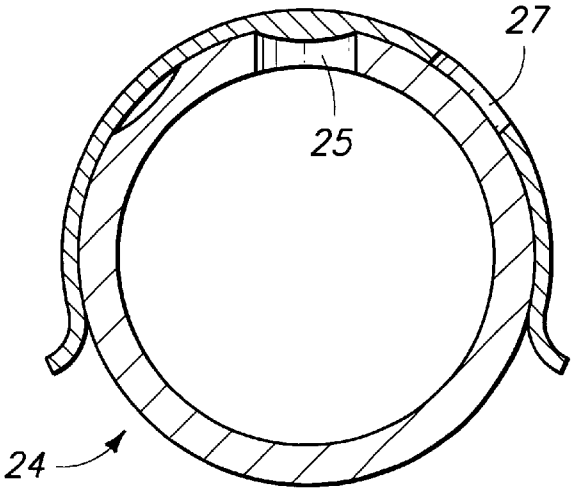
FIG. 10 is an enlarged sectional view taken substantially along line 10—10 in FIG. 9.
Figure 11:
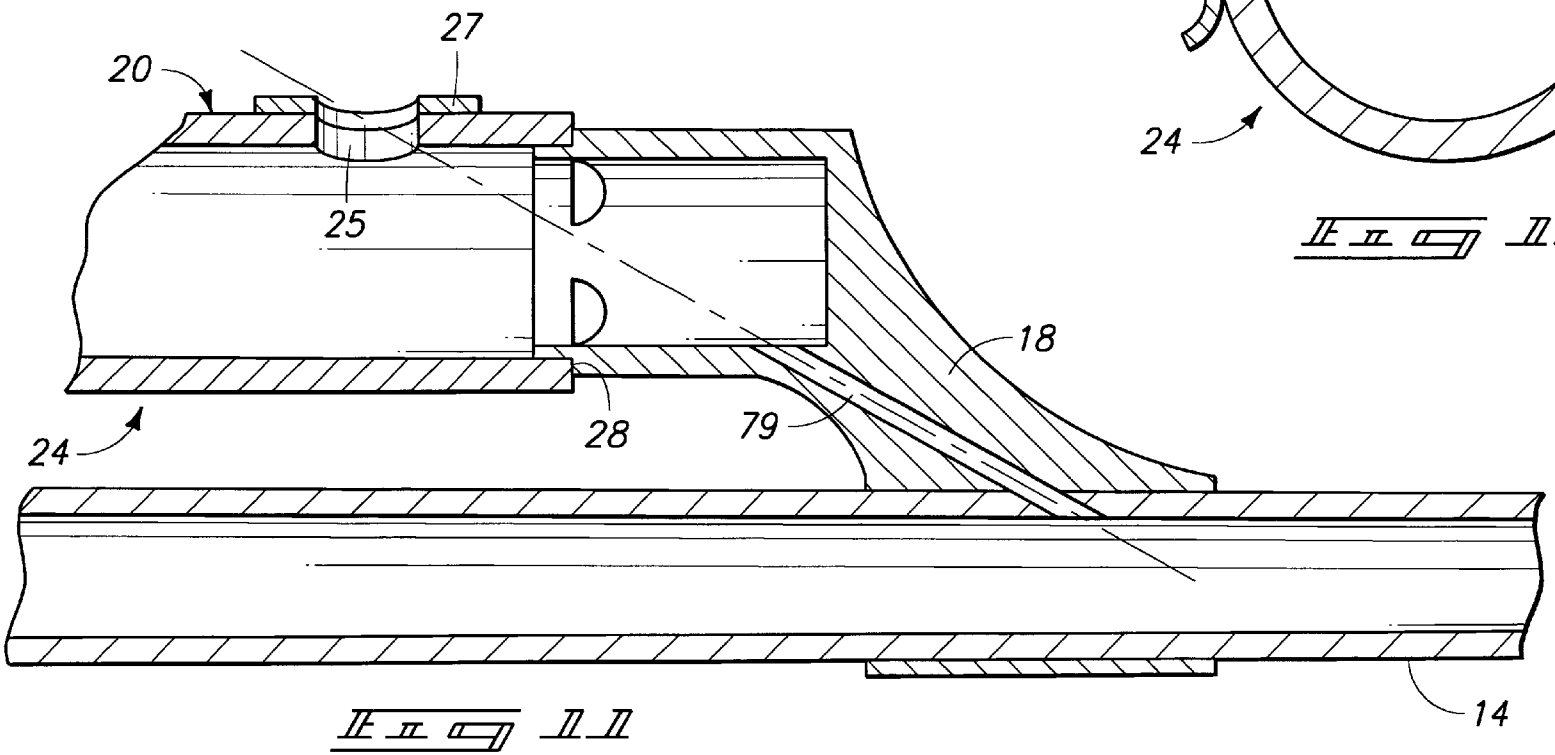
FIG. 11 is a fragmented sectional view illustrating a clean out opening in alignment with a gas duct in an associated gas chamber block.

In the exemplary gas tube shown in FIGS. 9–11, a clean-out hole 25 may be formed through the tube adjacent the open end 28. The clean-out hole 25 may be positioned to allow cleaning of the adjacent gas duct 79. A cover 27 may be mounted over the tube and be movable thereon to alternatively cover and seal the clean-out hole 25, or expose the hole 25 to permit cleaning of the gas duct 79.

Figure 5:
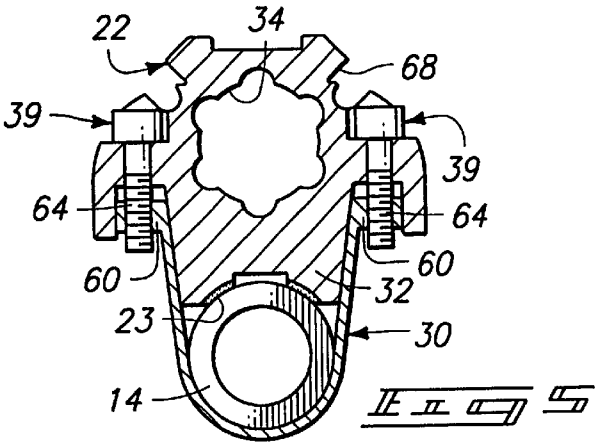
FIG. 5 is a sectional view taken substantially along line 5—5 in FIG. 3 but also showing a rifle barrel.
Figure 4:
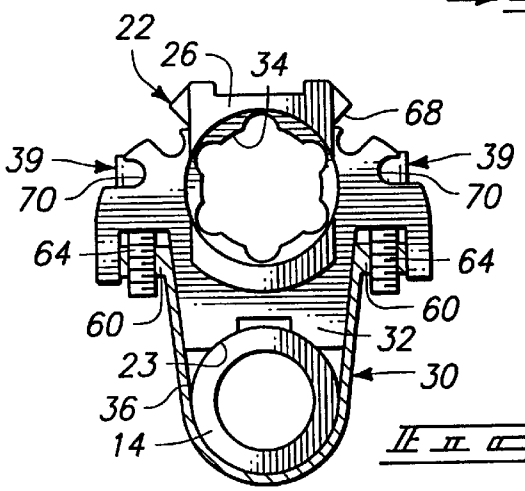
FIG. 4 is an end view of the mount substantially as seen from the left in FIG. 3, but showing the mount secured to a rifle barrel.

It is noted in FIGS. 4 and 5 that the bore of the integral gas tube 24 is longitudinally fluted. This configuration may be selected to match the internal configuration of the existing gas tube 80 of rifles that have similar fluted gas tube configurations (see FIG. 8). It may be understood also that the bore defined by passageway 34 may be produced to correspond with or match the gas tube bores of other gas tube configurations in various other AK47-type rifles.

It may be preferable to provide multiple barrel mounting members 30 along the optic mount 10 to securely attach the mount directly to the barrel 14. In preferred forms, each barrel mounting member 30 is a "U" shaped clamp member with upper ends 60 connected to the rigid body 20 and forming the barrel receiving throat 36 with the barrel mounting surface 23. The upper ends 60 may be secured by the tighteners 39 which may be provided in the form of headed screws 64 that are received through apertures in the rigid body and threadably engage the upper member ends 60. By selectively tightening the screws 64, the members 30 are drawn up tight to reduce the throat size and thereby clamp the barrel 14 and securely hold the mount in place on the rifle.

In the form exemplified by FIG. 8, and as briefly noted above, the optic mount 10 may be used with an existing conventional gas tube 80 that is typically provided as a part of the AK47-type rifle. To do this, a three piece construction of the mount may be used. Here it is preferable to provide the spacer 32 and barrel mounting surface 23 together in the separate spacer block 72. The separate spacer block 72 may be provided with a lower gas tube receiving surface 67 that mounts the existing gas tube 80 and may partially form the gas tube passageway 34. The tightener screws 64 may extend through aligned holes in the body 20 and spacer block 72, then threadably engage the upper member ends 60. The screws 64 may thus be tightened to secure the mount to the barrel without affecting the existing gas tube 80.

Mounting of the FIG. 8 form may be accomplished by first removing the existing gas tube 80 and fore end 87 from the rifle and removing the hand guard 13 from the gas tube 80. Now the barrel mounting members 30 may be fitted under the barrel 14 and the fore end 87 may be re-attached. The spacer blocks 72 may be then fitted to the top surface of the barrel and the existing gas tube may be re-fitted to the rifle so the spacer blocks 72 are captured between the barrel and gas tube. The rigid body 20 may next be mounted over the gas tube 80 and onto the spacer blocks 72. The mounting members 30 and spacer blocks 72 may be adjusted along the barrel until holes therein align with the appropriate holes in the body 20. The tightening screws 64 may then be fitted through the aligned holes and turned to threadably engage the mounting members 30 and secure the mount to the rifle barrel. An optical device may now be mounted to the mounting surface 22.

Mounting of the FIGS. 1–7 and 9 form may be accomplished simply by removing the existing gas tube 80 and hand guard 13, which may be set aside or discarded. The fore end 87 is also removed before the barrel mounting members 30 are fitted under the barrel. The members 30 may then be adjusted until the holes in the upper ends 60 align with appropriate holes in the rigid body 20. The fore end 87 may then be re-attached and the tightening screws be fitted through the aligned holes in threaded engagement with the mounting members 30. Tightening the screws will result in the members 30 and barrel mounting surfaces 23 being drawn tight against the barrel to secure the mount 10 in place. An optical device may now be mounted to the mounting surface 22.

As noted in FIG. 1, the optical device 84 may be positioned using the present mount 10 such that the line of sight L for the existing iron sights 42, 44 will pass through the optical device 84. With low power optics, as noted above, the shooter will now have the option of using either the iron sights 42, 44 or the optical sight 84. This facilitates quick target acquisition by the almost immediate capability of sight selection without requiring that the shooter change his or her eye level. The shooter is able to shoot with both eyes open and focused on the target, further adding to the speed of target acquisition.

In addition to the above advantages, the present mount may be used with optical sights without greatly affecting the overall height of the rifle. This is beneficial since, for example, standard carrying cases may be used without modification. The low profile sight also avoids snagging and facilitates handling in close quarters with minimal chance for damage from blows to the optics.

A still further advantage offered by the present mount is that the optics may be permanently mounted to the rifle without inhibiting or interfering with cleaning and maintenance of the rifle. The rifle may be disassembled and cleaned without requiring removal of the optics.

Another advantage provided by the present mount is that the optics may be mounted at a distance from the shooter's eye, thereby enabling use of both eyes for wide field of view target acquisition and sighting. The mount also facilitates positioning of the optics at a location along the rifle barrel where gas discharge will not harm the optics.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An optic mount for an AK47-type rifle having a barrel, a rear gas tube receiver block and a forward barrel mounted gas chamber block, the optic mount comprising:

a rigid body including an optic mount surface thereon;

a gas tube on the rigid body and including opposed open ends configured to be mounted to the rifle between the rear gas tube receiver block and forward barrel mounted gas chamber block; and a barrel mounting member releasably attached to the rigid body and configured to secure the rigid body to the barrel.

2. The optic mount of claim 1 wherein the optic mount surface is comprised of at least one optic mount rail formed along the rigid body.

3. The optic mount of claim 1 wherein the gas tube is defined by a gas tube passageway extending between the opposed open ends.

4. The optic mount of claim 1 wherein the rigid body further includes a barrel mounting surface thereon.

5. The optic mount of claim 1 wherein the rigid body further includes a barrel mounting surface thereon arranged in substantial parallel relation to the gas tube and optic mount surface.

6. The optic mount of claim 1 wherein the rigid body further includes a barrel mounting surface thereon and wherein the barrel mounting member is comprised of a "U" shaped clamp member with upper ends connected to the rigid body and forming a barrel receiving throat with the barrel mounting surface.

7. In an AK47-type rifle having a barrel, a rear gas tube receiver block and a forward barrel mounted gas chamber block, an optic mount, comprising:

a rigid body including an optic mount surface thereon and a gas tube;

wherein the gas tube is mounted to the rifle between the rear gas tube receiver block and the forward barrel mounted gas chamber block; and a barrel mounting member connecting the rigid body and the barrel.

8. The optic mount of claim 7 wherein the rigid body further includes a barrel mounting surface thereon.

9. The optic mount of claim 7 wherein the gas tube is integral with the rigid body.

10. The optic mount of claim 7 wherein the gas tube includes opposed open ends in communication with a bore that extends between the opposed ends and wherein the rigid body further includes a barrel mounting surface thereon in opposition to the optic mounting surface with respect to the bore.

11. An optic mount for an AK47-type rifle barrel, comprising:

a rigid body including an optic mount surface and a barrel mounting surface thereon;

a gas tube spacer on the rigid body spacing the optic mount surface from the barrel mounting surface and defining a gas tube passageway with the rigid body between the barrel mounting surface and the optic mount surface; and a barrel mounting member on the rigid body and depending from the barrel mounting surface to form a barrel receiving throat.

12. The optic mount of claim 11 wherein the gas tube spacer is integrated with the rigid body.

13. The optic mount of claim 11 wherein the gas tube spacer is releasably attached to the rigid body.

14. The optic mount of claim 11 wherein the gas tube passageway is defined as a space between the gas tube spacer and the optic mount surface, configured to receive an AK47-type rifle gas tube.

15. The optic mount of claim 11 further wherein the barrel mounting member is releasably connected to the rigid body and gas tube spacer to form the barrel receiving throat.

16. In an AK47-type rifle having a barrel, a rear iron sight and a front iron sight defining a line of sight with the rear iron sight, a rear gas tube receiver block, and a forward barrel mounted gas chamber block; an optic mount, comprising:

a rigid body including an optic mount surface thereon;

wherein the rigid body is mountable to the rifle between the rear gas tube receiver block and the forward barrel mounted gas chamber block with the optic mount surface situated between the barrel and the line of sight; and a barrel mounting member on the rigid body and engageable with the barrel to secure the rigid body to the barrel.

17. The optic mount of claim 16 wherein the rigid body includes a barrel mount surface and a gas tube spacer between the optic mount surface and barrel mount surface.

18. The optic mount of claim 16 wherein the rigid body includes a gas tube with opposed open ends positionable in communication with the rear gas tube receiver block and the forward barrel mounted gas chamber block.

19. The optic mount of claim 16 wherein the rigid body includes a barrel mount surface; and further comprising a gas tube spacer between the optic mount surface and barrel mount surface and wherein the gas tube spacer at least partially defines a gas tube passageway.

20. The optic mount of claim 16 further comprising a gas tube on the rigid body, including a forward open end, a clean-out hole formed through the gas tube adjacent to the forward open end; and a cover on the gas tube and selectively movable to alternatively cover and expose the clean-out hole.

* * * * *

UNITED STATES PATENT AND TRADEMARK OFFICE

CERTIFICATE OF CORRECTION

PATENT NO. : 6,381,895 B1
DATED : May 7, 2002
INVENTOR(S) : Lyle J. Keeney et al.

It is certified that error appears in the above-identified patent and that said Letters Patent is hereby corrected as shown below:

Column 1,
Line 67, replace "carried" with -- carried. --

Column 2,
Line 38, replace "fulfilled by is provision of the present invention," with -- fulfilled by provision of the present invention, --

Column 6,
Line 17, replace "It is noted 8 however that the conventional" with -- It is noted however that the conventional --

Signed and Sealed this

Thirty-first Day of December, 2002

JAMES E. ROGAN
*Director of the United States Patent and Trademark Office*